United States Patent [19]

Pelloux-Gervais et al.

[11] Patent Number: 4,889,113

[45] Date of Patent: Dec. 26, 1989

[54] HOOD FOR PROTECTING AGAINST SMOKE AND HYPOXIA

[75] Inventors: Pierre Pelloux-Gervais, Seyssins; Richard Zapata, Sassenage; Michel Bres, Apprieu, all of France

[73] Assignee: l'Air Liquide, Societe Anonyme pour l'Etude et l'Exploitation des Procedes Georges Claude, Paris, France

[21] Appl. No.: 40,157

[22] Filed: Apr. 20, 1987

Related U.S. Application Data

[63] Continuation-in-part of Ser. No. 825,489, Jan. 30, 1986, abandoned.

[30] Foreign Application Priority Data

May 31, 1985 [FR] France ..... 85 08208
May 28, 1986 [WO] PCT Int'l Appl. ... PCT/FR86/00179

[51] Int. Cl.[4] ..... A62B 7/10

[52] U.S. Cl. ..... 128/201.25; 128/205.12; 128/205.17; 128/205.25

[58] Field of Search ..... 128/201.29, 201.23, 128/201.24, 201.25, 201.26, 201.28, 205.21, 205.25, 205.12, 205.26, 205.17; 222/3, 5, 6; 2/463, 462

[56] References Cited

U.S. PATENT DOCUMENTS

| | | | |
|---|---|---|---|
| 3,250,292 | 5/1966 | Mollick | 137/505.28 |
| 3,270,708 | 9/1966 | Kamowski | 137/327 |
| 3,491,752 | 1/1970 | Cowlely | 128/201.22 |
| 3,762,407 | 10/1973 | Shonerd | 128/201.23 |
| 3,976,063 | 8/1976 | Hennoman et al. | 128/205.21 |
| 4,116,237 | 9/1978 | Birch | 128/201.23 |
| 4,233,970 | 11/1980 | Kranz | 128/201.28 |
| 4,523,588 | 6/1985 | Dolsky | 128/201.25 |
| 4,552,140 | 11/1985 | Cowley et al. | 128/201.28 |
| 4,754,751 | 7/1988 | Mausteller et al. | 128/201.25 |

FOREIGN PATENT DOCUMENTS 2651917 5/1978 Fed. Rep. of Germany .

*Primary Examiner*—Max Hindenburg
*Assistant Examiner*—K. M. Reichle
*Attorney, Agent, or Firm*—Young & Thompson

[57] ABSTRACT

The invention relates to a hood for protecting against smoke and hypoxia which is of use more particularly in the protection of flying personnel in aircraft. This hood comprises, at its base and within the fluidtight cover a closed tube (3) surrounding the neck of the wearer and containing a reserve supply of oxygen under pressure, and means (11–13) for automatically putting, when the hood is donned, the interior of this tube in communication with an automatic supply of oxygen to the wearer of the hood.

11 Claims, 4 Drawing Sheets

HOOD FOR PROTECTING AGAINST SMOKE AND HYPOXIA

This application is a continuation-in-part of our copending application Ser. No. 825,489, filed Jan. 30, 1986, now abandoned.

The present invention relates to a hood for protecting against smoke and hypoxia, of use more particularly in the protection of flying personnel in aircraft, comprising a fluidtight cover forming a helmet covering the head of the wearer and, in its lower part, sealing means connecting the hood to the neck of the wearer.

At the present time, there exist for the protection of flying personnel against accidental depressions or smoke created in the cabins, open-circuit devices which comprise a compressed oxygen cylinder which is capable of supplying about 300 liters of gas and is connected to a conventional mask of aviation type. These open-circuit devices are effective but have the drawback of being difficult to employ, heavy and bulky.

Other autonomous breathing systems operating in a closed circuit which ensure the combined protection against altitude hypoxia and smoke are usually in the form of a hood which is donned by the individuals in the event of necessity and is provided with fluidtight closing means in the region of the neck. Such a hood comprises, on one hand, means for injecting into the interior oxygen sufficient for the consumption of the individual wearing the hood and, on the other hand, means for trapping carbon dioxide so as to limit its content within the hood.

The absorption of carbon dioxide is achieved by means of an absorbent of the soda lime, lithia, molecular sieve type etc. The absorption efficiency depends on one hand on the absorbent product and on the other hand on the good circulation through the bed of absorbent material of the gases contained in the respiratory enclosure in the hood.

Protective hoods known at the present time are of two types, namely of the static type or of the mechanical type. In the first case, carbon dioxide is absorbed solely by the convection movements of the gases within the hood and in order to achieve a good absorption efficiency the surface and the mass of absorbent material become rapidly unsuitable for application in the aeronautic field. In the second case, i.e. that of a mechanical method, the gases are circulated through the absorbent bed either by means of a mechanical fan supplied with current by a battery or by means of an injector employing for example the energy of the expansion of the source of oxygen.

All these known systems present problems of reliability, in particular due to the required duration of life exceeding five years and efficiency, in particular in the case of the use of an injector when the pressure of the volume of oxygen drops. Further, the complexity of such systems requires a regular checking of the state of the equipment.

An object of the present invention is to overcome these drawbacks by providing a protective hood of particularly simple, compact and light design which guarantees a long life, is capable of supplying the oxygen required for human consumption for a rather long period of time and permits the obtainment of very high efficiency as concerns the trapping of the carbon dioxide.

The invention therefore provides a protective hood which comprises, at its base and within the fluidtight cover, a closed tube surrounding the neck of the wearer and containing a reserve supply of oxygen under pressure, and means for automatically putting, when the hood is placed on the head, the interior of this tube in communication with the interior of the fluidtight cover so as to ensure an automatic supply of oxygen to the wearer of the hood.

According to a further feature of the invention, the tube containing the oxygen under pressure advantageously comprises two distinct compartments preferably in series relation so as to provide a supply of oxygen with two different flow rates, namely a high initial flow for rapidly inflating the hood, and then a lower flow corresponding to the normal consumption of oxygen on the part of the wearer.

According to a preferred embodiment of the invention, the hood comprises a second flexible outer cover of gastight material which is fixed along its edges in a sealed manner to the first cover, and the wall of the first fluidtight cover is interrupted in at least one region so as to define in this wall an opening across which is disposed a product absorbing carbon dioxide and/or water.

There will be described hereinafter by way of non-limiting examples various embodiments of the present invention with reference to the accompanying drawings, in which.

Figure 1:
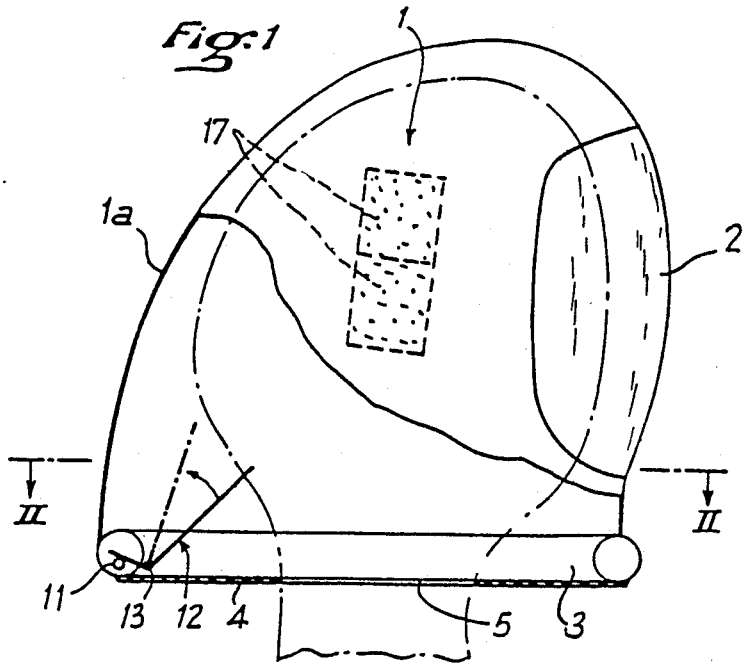
FIG. 1 is an elevational view, partly in vertical section, of a protective hood according to the invention.
Figure 2:
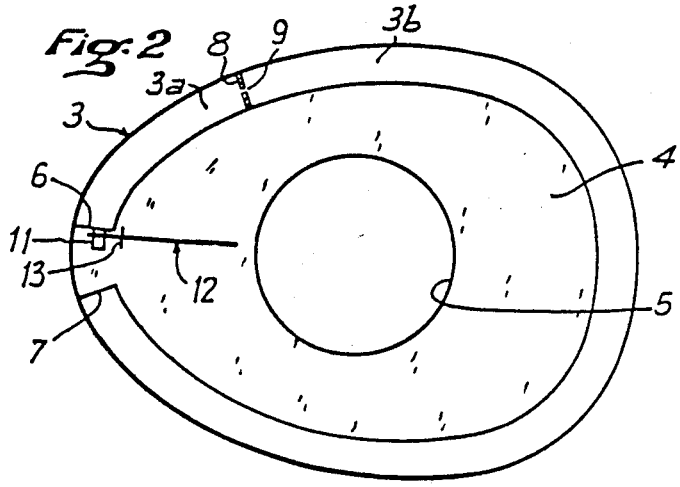
FIG. 2 is a horizontal sectional view taken on line II—II of FIG. 1.

The protective hood represented in FIGS. 1 and 2 comprises a cover 1 of a fluidtight, preferably elastic, material forming a sort of helmet which covers the head of the wearer and comprises, in its front part, a transparent part 2 forming a visor providing a view of the exterior, if the cover 2 is not itself of transparent material. This fluidtight cover 1 is connected in its lower part to a tube 3 in the form of a split ring surrounding the neck of the wearer and constituting a reserve supply of oxygen. This tube 3 is mounted, in its lower part, on a horizontally extending, flexible and elastic sheet 4, for example of rubber. This sheet 4, which is tangent to the tube 3, is provided in its central part with an opening 5 to permit the passage of the head of the wearer of the hood through this opening.

The tube 3 may have, when viewed in plan, any suitable curved shape enabling it to surround the wearer's neck. It may be in particular circular or have a substantially oval shape as shown in FIG. 2.

The tube 3 is closed at both ends by frontal transverse walls 6 and 7 which are disposed in facing relation in the rear part of the hood at a certain distance from each other. The tube 3 is advantageously subdivided by a transverse wall 8 provided with a calibrated or capillary orifice 9, into two compartments 3*a* and 3*b*. These two compartments are filled with oxygen under pressure, for example 150 da N/cm$^2$. The compartment 3*a*, which is defined between the transverse partition wall 8 and the frontal wall 6, may communicate with the exterior through a calibrated or capillary orifice 10 which is provided in the frontal wall 6 and communicates with a hollow end member 11 forming a closing plug fixed by welding or any other suitable means to the frontal wall 6. This end member 11 is of small size and adapted to be very easily broken by a percussion device 12 automatically actuated when the head of the wearer is inserted into the hood. This percussion device may be formed, for example, by a lever which is pivotally mounted on the tube 3 by a pin 13 and has a branch which extends toward the interior of the hood so as to be capable of being pushed back by the head of the person who dons the hood, and a shorter branch which acts on and breaks the end member 11.

Consequently, at the beginning of the donning of the hood, the lever 12 breaks the end member 11 so that the oxygen under pressure contained in the tube 3 can escape to the interior of the hood. The calibrated or capillary orifice 10 has a diameter which is large enough to ensure a relatively high rate of flow, namely about 0.06 l/mn bar, which enables the hood to be rapidly inflated when it is placed in position. This rate of flow, which is higher than 0.03 l/mn bar, is however sufficiently low (lower than 0.02 l/mn bar) to avoid emptying the chamber constituted by the tube 3 too quickly and causing an excessive loss of gas if the hood is donned badly (jamming or escape when passing over obstacles, such as glasses or a bun, etc.). The calibrated or capillary orifice 9 provided in the transverse wall 8 acts as a relay and the chamber constituted by the compartment 3*b* is slowly emptied to ensure the rate of flow required for the consumption of oxygen, namely at the minimum 1.5 l/mn.

Figure 3:
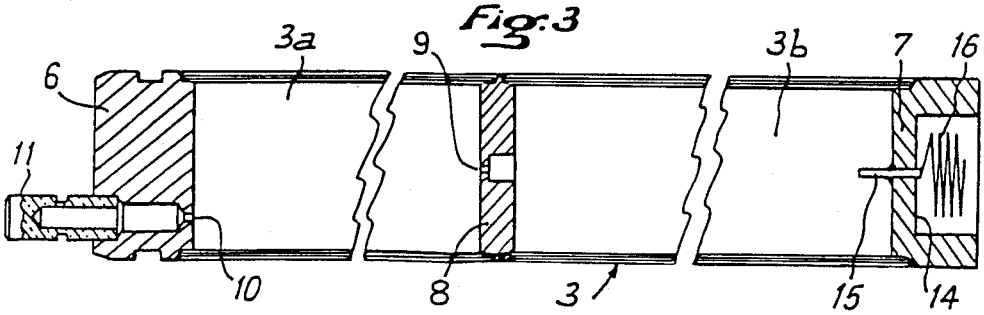
FIG. 3 is a developed axial sectional view, to an enlarged scale, of the closed tube constituting the reserve supply of oxygen under pressure.

It can be seen in FIG. 3 that the frontal wall 7 which faces the frontal wall 6 carrying the end member 11 has a hollow central portion 14 from the inner end of which projects a capillary tube 15 communicating with the interior of the compartment 3*b*. This capillary tube is extended outside the tube in the form of a helical structure 16 whose end is closed. This helical structure 16, which is axially deformable as a function of the pressure prevailing inside the tube 3, may therefore constitute a pressure gauge indicating the residual pressure inside the tube.

The fluidtight cover 1 preferably comprises a rear part 1*a* which is more flexible than the rest of the cover so as to constitute a kind of inflatable "lung."

The cover 1 also contains a device for trapping carbon dioxide. This device may be formed, for example, by grains of soda lime which permanently remove from the gases exhaled impurities and in particular carbon dioxide by absorption of the latter. The wearer of the protective hood according to the invention may consequently breathe in a closed circuit with a small supply of oxygen. In order to increase the area of exchange with the absorbent material, the hood preferably has the shape of a balaclava helmet as represented in the drawing.

Figure 4:
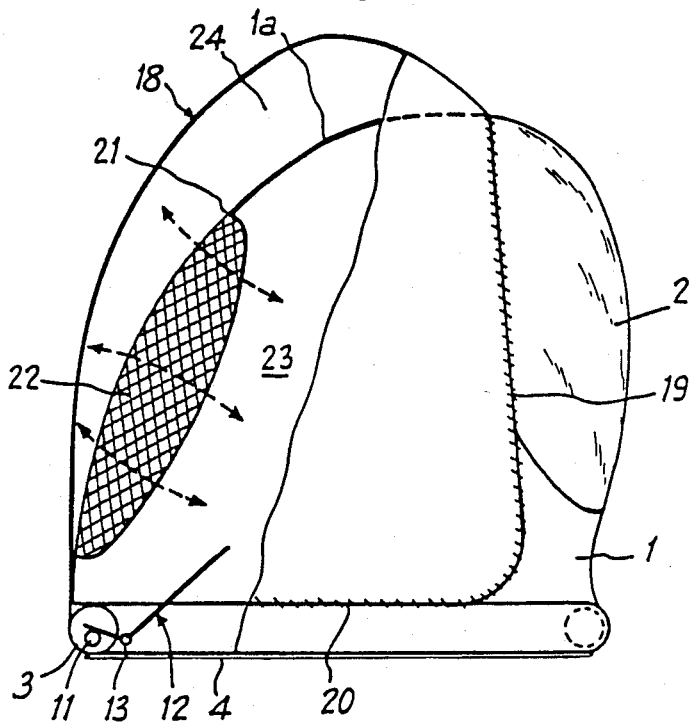
FIG. 4 is an elevational view, partly in vertical section, of a modification of the protective hood according to the invention.
Figure 5:
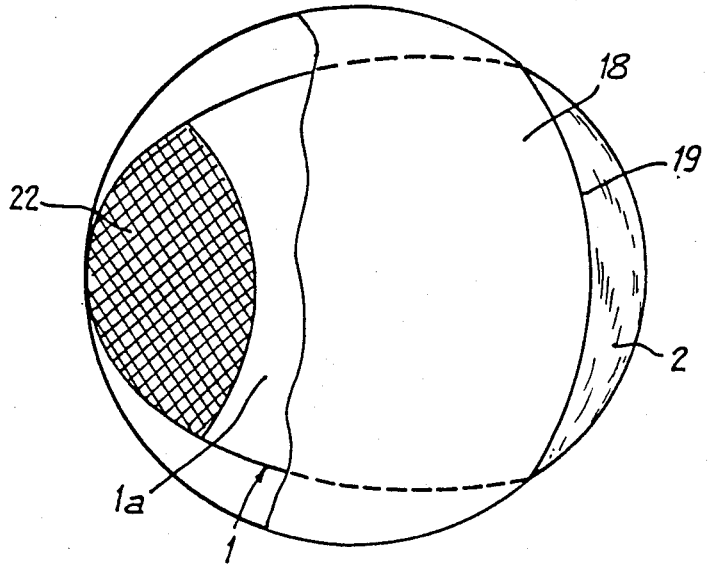
FIG. 5 is a plan view, with a part cut away, of the protective hood of FIG. 4.

In the embodiment shown in FIGS. 4 and 5, the protective hood comprises a second flexible outer cover 18 of gastight material which is fixed along its edges 19, 20 in a fluidtight manner to the first cover 1. This fixing may be for example by welding. The fluidtight welding of the edge 19 extends along the visor 2 and is connected to the lower fluidtight welding 20 which extends horizontally in the upper horizontal plane tangent to the tube 3.

The wall of the inner fluidtight cover 1 is interrupted in at least one region, for example in the lower part of the rear wall 1*a*, so as to define in this wall an opening 21 across which there is disposed a pad 22 of porous material such as a metal grid or a net of fiberglass. A product which absorbs carbon dioxide and possibly water is held stationary inside this porous material.

The inner cover 1 and the outer cover 18, which has a larger surface area than the part of the inner cover 1 it covers, therefore define therebetween two compartments, namely an inner compartment 23 in which the head of the wearer is located, and an outer compartment 24 of variable volume forming a sort of "lung".

With the arrangement according to the invention, the gases permanently pass, during the breathing of the wearer of the hood, alternately in one direction and the other between the two compartments 23 and 24 through the bed of absorbent material contained in the porous pad 22. During expiration, the gases pass from the inner compartment 23 to the outer compartment 24 and, during inspiration, the gases flow in the opposite direction. Thus, exhaled impurities and in particular carbon dioxide are permanently removed from the gases. The wearer of the protective hood according to the invention may consequently breathe in a closed circuit with a small supply of oxygen.

Figure 6:
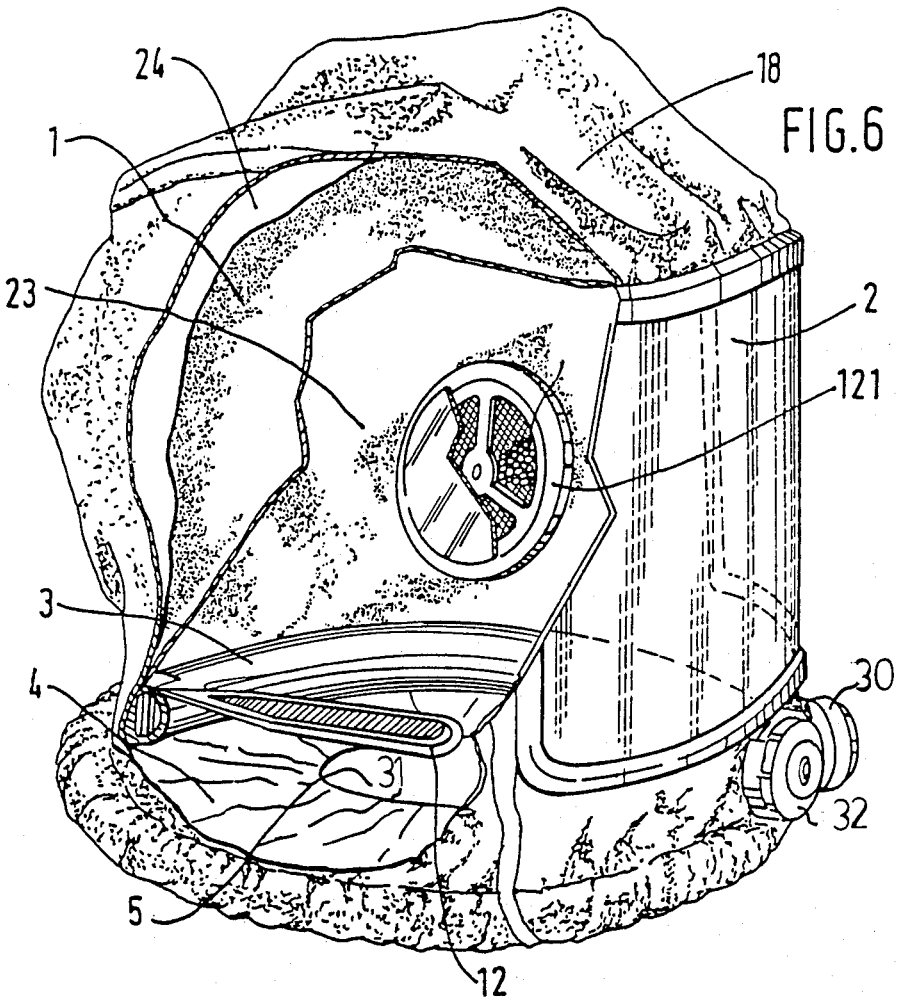
FIG. 6 is a perspective view, partly in section, of an embodiment of the invention.

FIG. 6 is a view, partly in section, of an embodiment of a hood according to the invention. In this Figure, elements similar to those of the preceding Figures carry the same reference characters. The covers 1 and 18 are made from polyester coated on both sides with fireproof PVC. The total volume of the hood is 17 liters, 7 liters of which are for the volume 23 of the head and 10 liters for the volume 24 of the "lung". Reference numeral 121 indicates a soda lime cartridge 22 maintained in a cavity closed by a fine grid and coated with a protective plate 122 provided with a system of lateral openings for the passage of air from the head volume 23 into the lung 24 through the soda lime 22 which removes excess water and carbon dioxide from the air. The volumes 23 and 24 are fluidtight with respect to each other and the air necessarily passes through the soda lime cartridges (two cartridges in the presently-described embodiment). The lever 12, which has the shape of a palette, is placed above the opening 5.

Figure 7:
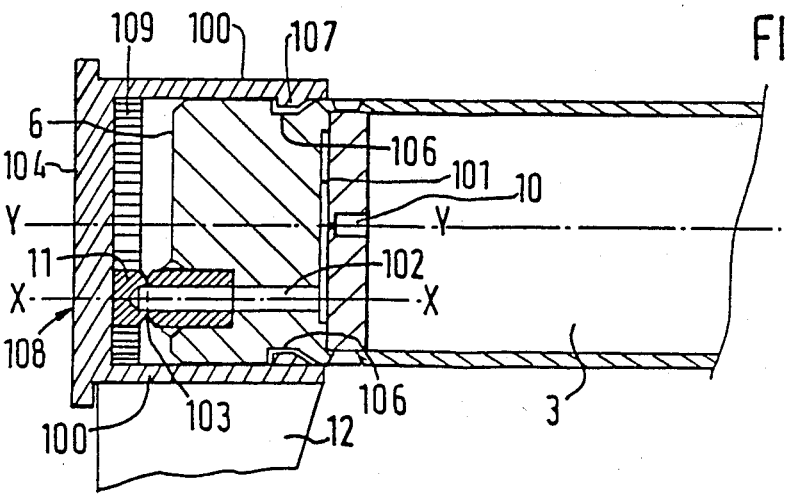
FIG. 7 is a sectional view of a detail of the hood of FIG. 6.

The system for opening the oxygen chamber 3, which here has a single volume, is represented in FIG. 7. The hollow end member 11 is mounted on a cylindrical cap 108 whose inner lateral wall 100 carries, at its base, lugs 107 which cooperate with an annular groove 106 defined in the frontal wall 6. The lever 12 is mounted on said wall 100. The hollow end member 11 has a circular groove 103. When the hood is placed on the head, the rotation of the palette 12 results in a rotation of the cylindrical cap 108 about the axis Y—Y which causes the breakage of the hollow end 11 in the region of the groove 103, the axis X—X of said end member being parallel to the axis Y—Y but spaced from the latter.

The oxygen in the reservoir 3 which has only one compartment is therefore released through the jet 10 of the cavity 101 and then the conduit 102. By way of example, the jet 10 has a diameter of 6/100 mm releasing 40 liters of oxygen stored under a pressure of 150 bars in the reservoir 3. The autonomy of such a hood is about 15 minutes.

Figure 8:
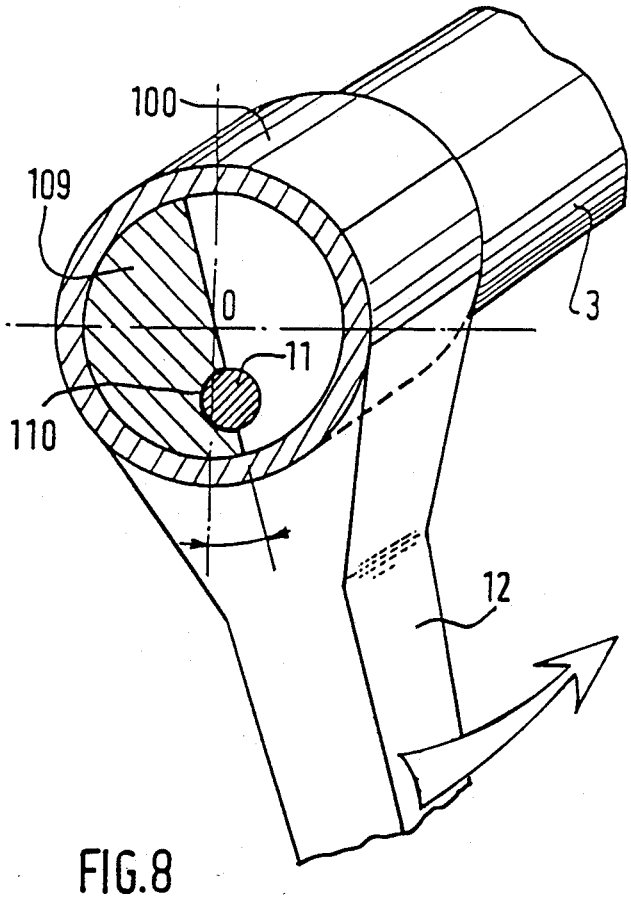
FIG. 8 is a side elevational view of the device of FIG. 7.

FIG. 8 is a perspective view of the device of FIG. 7. This figure clearly shows the shape of the element 109 mounted on the palette 12 and the cap 108 which cooperates with the end of the element 11 for the purpose of breaking the latter. This element 109 has a semi-circular surface whose diameter passes through the axis Y—Y. It defines below this axis Y—Y (as viewed in FIG. 8) a semi-circular recess 110 whose diameter is identical to that of the member 11 and in which the latter bears when the lever 12 is in a position of rest. The rotation of the palette (toward the right in FIG. 8) about the point 0 (axis Y—Y) causes the breaking off of the end portion of the member 11 located in front of the recess 103 and having a length identical to the thickness of the element 109, and the release of oxygen through the conduit 102.

"Sealing means" in the present invention means that substantially no gas coming from the exterior surrounding atmosphere of the wearer of said hood can penetrate into the hood, to be inhalated by the wearer. However, this means also that no substantial over pressure of breathable gas can be generated inside the hood: in this latter case this gas can escape outside the hood to maintain approximately the same pressure within and outside said hood.

Accordingly, these sealing means are represented on FIG. 6 by references 30, 32 and 31. References 30 and 32 are a type of check valves which permit air from the inside part 23 of the hood to escape outside, when a slight over pressure, said about 2 mbars, exists between the atmosphere of the inside part 23 and the outside atmosphere. Reference 31 is a resilient means (elastic yarn) which defines the diameter of the aperture 5 smaller than that of the usual wearer's head. This resilient means provides a seal between the hood and the wearer's neck. However, this seal is "relative" in that it does not allow gas exchanges between the inside part of the hood and the outside atmosphere up to a predetermined difference of pressure between both, which can be practically, substantially around 10 mbars. This is mainly due to the underpressures (in the planes) which can occur in the outside atmosphere. But this is not due to the generation of oxygen in the hood. The flow of oxygen from the oxygen reservoir means is commensurate with the quantity of oxygen burnt by the wearer's body which exhales $C0_2$ and/or water which are trapped and/or condensed and no increase of pressure actually occurs inside the hood in normal conditions. On the contrary, the flow of oxygen gas may be regulated in such a way that, after establishing the permanent flow regimen of oxygen, there is a slight over consuming of oxygen by the wearer than the oxygen flow from the oxygen reservoir means, which means that oxygen is extracted by the wearer from the initial atmosphere in the hood and the lung there becomes very useful.

Anyway, the volume 24 of the "lung" will be preferably greater than that of the volume 23, while the volume of the "lung" 24 will be preferably greater than the average volume of the wearer's lung.

We claim:

1. A helmet for protecting against smoke or hypoxia, comprising inner and outer gas tight flexible covers, said inner cover being substantially transparent in a place adapted to register with a wearer's eyes, said inner cover being adapted to enclose the head of a wearer and said outer cover enclosing a portion of the exterior surface of said inner cover, said covers thus constituting a hood adapted to cover the head of the wearer, said hood having, in its lower part, sealing means adapted to connect the hood to the neck of the wearer, said helmet further including breathable gas supply means attached thereto, said portion of said inner cover and said outer gas tight flexible cover being secured together along their edges to define between them a first volume, while said inner cover and said sealing means define a second volume, said portion of said inner cover being interrupted in at least one region so as to define in this portion at least one opening through which said first and second volumes communicate with each other to allow the breathable gas to go back and forth through said opening, said covers being adaptable to move towards and away from each other according to a breathable gas demand from the wearer, making said first volume adapted to vary according to the wearer's inhalations and/or exhalations, porous filter means being placed in each of said openings for absorbing carbon dioxide and/or water from the breathable gas during its travel back and forth therethrough.

2. A helmet according to claim 1, wherein said porous filter means is a cartridge containing soda lime.

3. A helmet according to claim 1, wherein it further comprises removable closing means for automatically communicating said gas supply means with said helmet.

4. A helmet according to claim 1, further comprising a detachable closing means to activate the supply of breathable gas from the breathable gas supply means.

5. A helmet according to claim 1, comprising as said breathable gas supply means, at its lower part, a closed tube adapted to surround at least partly the neck of the wearer and containing a reserve supply of oxygen under pressure, and means to supply oxygen from said tube to at least one of said volumes.

6. A helmet according to claim 5, in which the tube has the form of a split ring, and transverse walls by which the tube is closed at its two ends facing each other.

7. Protective helmet according to claim 5, in which the tube containing the oxygen under pressure comprises two separate compartments and said means to supply oxygen including flow control means controlling the flow of oxygen from each of said compartments, said flow control means respectively offering two different resistances to the flow of gas therethrough, thereby permitting obtaining a feed of oxygen with two different flow rates, namely, a high initial flow rate to obtain rapid filling of the helmet, then a lower flow rate corresponding to the normal oxygen consumption of the wearer.

8. Protective helmet according to claim 7, in which the tube contains a transverse partition separating it into the two compartments and end walls, said flow control means including a capillary hole through said partition, a hole through one of said end walls, said capillary hole being of smaller diameter than said hole through said one end wall of the tube, and removable closure means closing the last-named hole.

9. Protective helmet according to claim 8, wherein the removable closure means is a rupturable nipple.

10. Protective helmet according to claim 8, in which the other end wall is opposite to the one wall having the last-named hole and has a central recess, a capillary tube which extends through the bottom of said central recess, one end of said capillary tube opening into the interior of the tube, the other end of the capillary tube is closed and extends exteriorly of said tube in the form of a helix which is axially deformable as a function of the pressure prevailing in the interior of the tube, thereby to constitute a manometer indicating the residual pressure in the interior of the tube.

11. A helmet according to claim 1, wherein it further comprises a lever pivotally mounted on the helmet about an axis and having leg means that extends into the interior of the helmet and being adapted to be pressed by the wearer's head when donning the helmet causing said lever to pivot, and valve means actuatable by pivoting of the lever in order to communicate breathable gas from the breathable gas supply means to said helmet.

* * * * *